US005232403A

United States Patent [19]

Marotta

[11] Patent Number: 5,232,403

[45] Date of Patent: Aug. 3, 1993

[54] AIR REGISTER WITH EXTENDABLE DEFLECTOR

[76] Inventor: Joseph Marotta, 502 Norfold Sq., Pickering, Ontario, Canada, L1V 3Y5

[21] Appl. No.: 935,796

[22] Filed: Aug. 27, 1992

[51] Int. Cl.[5] ..... F24F 13/08

[52] U.S. Cl. ..... 454/289; 454/290; 454/307

[58] Field of Search ..... 454/104, 155, 284, 289, 454/290, 307

[56] References Cited

U.S. PATENT DOCUMENTS

| | | | |
|---|---|---|---|
| 37,338 | 1/1863 | Dowling . | |
| 848,758 | 4/1907 | Meibeyer | 454/290 |
| 1,463,318 | 7/1923 | Heartick . | |
| 1,597,972 | 8/1926 | Heartick . | |
| 1,607,092 | 11/1926 | Lyon . | |
| 1,640,630 | 8/1927 | Walloch . | |
| 1,690,001 | 10/1928 | Filkins | 454/290 |
| 1,691,285 | 11/1928 | Helms | 454/307 X |
| 1,768,085 | 6/1930 | Leatherman | 454/155 |
| 1,893,571 | 1/1933 | Walloch . | |
| 1,921,305 | 8/1933 | Wiesman | 454/307 |
| 3,861,281 | 1/1975 | Godwin | 454/155 |
| 3,921,507 | 11/1975 | Condet et al. | 454/155 |
| 4,610,196 | 9/1986 | Kern | 454/155 |

*Primary Examiner*—Harold Joyce

*Attorney, Agent, or Firm*—Shlesinger Arkwright & Garvey

[57] ABSTRACT

In an air register comprising a register frame defining an air outlet, a deflector is rested in retracted position and extensible from the frame to a preselected position over the air outlet. A shaft axially movable transverse to the deflector together with means to move the shaft against the deflector to releaseably retain 7 Claims, 3 Drawing Sheets

AIR REGISTER WITH EXTENDABLE DEFLECTOR

FIELD OF THE INVENTION

This invention relates to an extendable nesting deflector in an air register which allows for the adjustable redirection of air entering a room.

BACKGROUND OF THE INVENTION

There are several known types of hot air deflectors which are used in association with heat registers. One such device is shown in U.S. Pat. No. 1,691,285 to Henry C. Helms which discloses a register having a grate which when extended forms a hood with side walls over the register. The Helms device uses a curved latch lever which allows for positioning of the hood in only a few selected positions. Furthermore the latch is easily disengagable causing the hood to be unstable.

Another device is shown in U.S. Pat. No. 848,758 to C. H. Meibeyer which discloses a hot-air register having a retractable hood operated by a levered treadle mechanism, utilizing a complicated rod and lever connection.

STATEMENT OF THE INVENTION

The present invention overcomes the above-mentioned drawbacks of the prior art by providing an air register with a deflector which is comprised of simple and easily constructed components.

In its broadest aspect the invention consists of an air register comprising a register frame defining an air outlet, a deflector nested in retracted position in the frame and extensible therefrom to any preselected position over the air outlet and a means for releasably retaining the deflector in said preselected position comprising a shaft axially movable transverse to the deflector and means to move the shaft against the deflector.

BRIEF DESCRIPTION OF THE DRAWINGS

In the accompanying drawings which illustrates an example embodiment of the invention.

DESCRIPTION OF PREFERRED EMBODIMENTS

Figure 1:
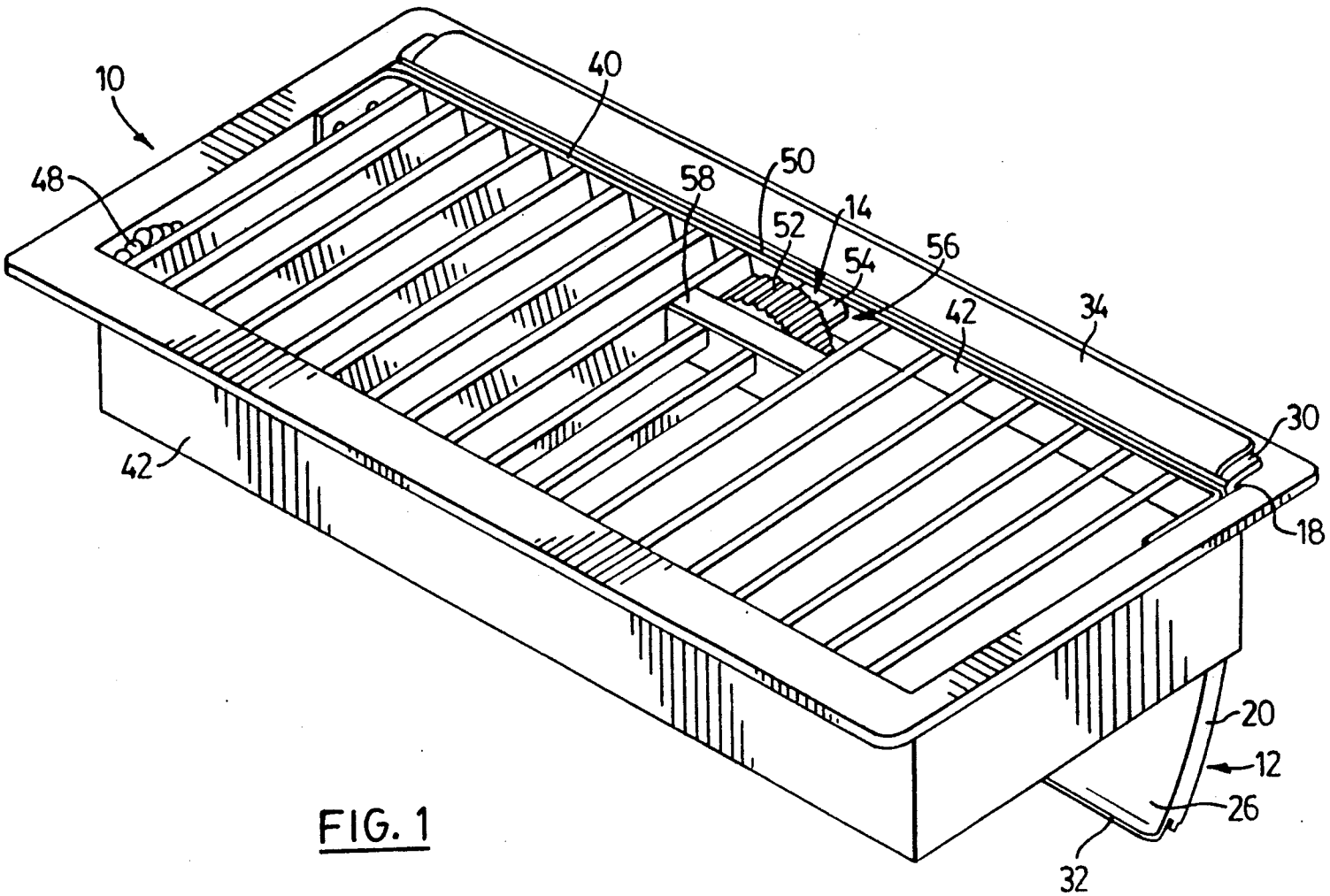
FIG. 1 is a perspective view of a register showing a deflector nested in retracted position in the register.

The embodiment shown in the drawings consists of a register frame 10, a deflector 12 and a means 14 for releasably retaining the deflector 12 in a preselected position.

One side of register frame 10 has an elongated slot 18 which receives deflector 12.

Deflector 12 comprises an outer arcuate sheet 20 and an inner arcuate sheet 22, one sheet being slidable with respect to the other. Outer arcuate sheet 20 has two spaced walls 24 and 26 defining a cavity 28 within which inner arcuate sheet 22 is slidable. Outer sheet 20 carries a stop flange 30 on its upper edge and a further stop flange 32 on its lower edge. Inner arcuate sheet 22 has a stop flange 34 at its upper edge. A stop 36 fixed to inner sheet 20 projects into a vertical slot 38 in outer wall 24 of outer sheet 20 and is frictionally slidable therein.

Register frame 10 has a grate 40 bridging a pair of spaced side walls 42. A pair of dampers 44 are positioned in an aperture 46 in the bottom of frame 10 and operated by a dial 48 in known manner. Slot 18 is defined by side wall 42 and side bar 50 of grate 40. Means 14 for releasable retaining deflector 12 comprises a thumbwheel 52 keyed on a threaded shaft 54 engaged in a threaded aperture 56 in side wall 42 for longitudinal movement against inner wall 26 of outer sheet 24 of deflector 12. A backstop 58 fixed onto register frame 10 prevents threaded shaft 54 from being disengaged from aperture 56.

Figure 2:
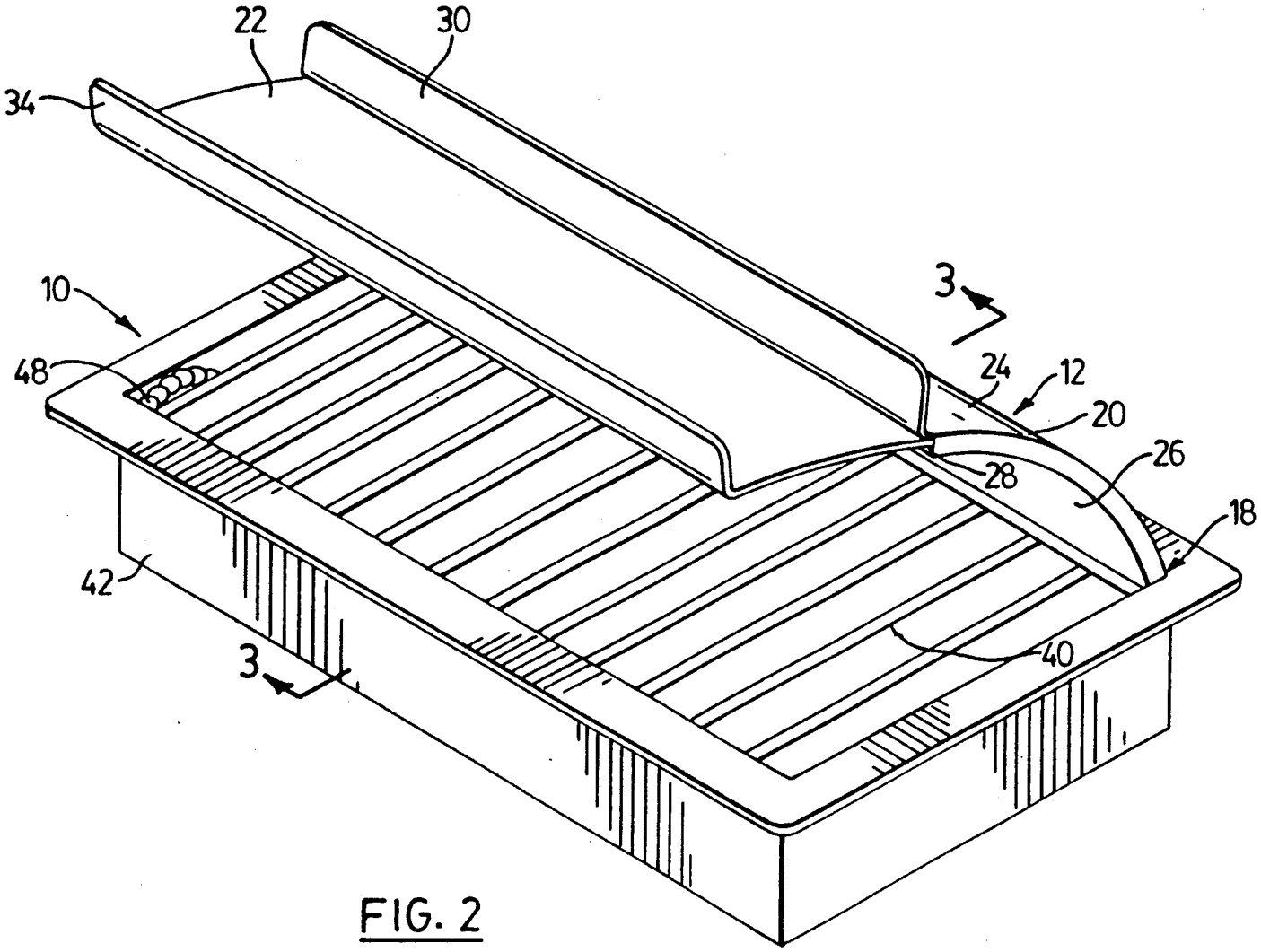
FIG. 2 is a perspective view of the device shown in FIG. 1 wherein the deflector has been extended from the nested position.
Figure 3:
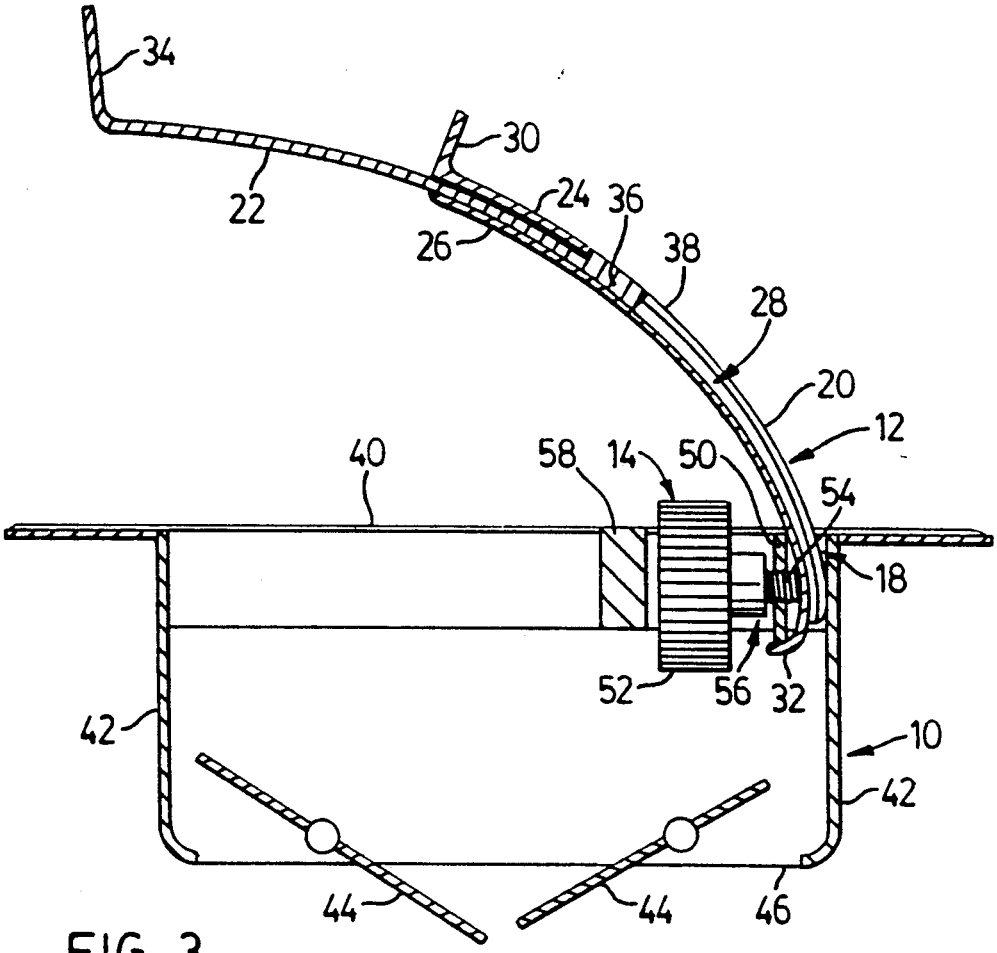
FIG. 3 is a cross section taken along the line 3—3 of FIG. 2 in which the deflector is nested.
Figure 4:
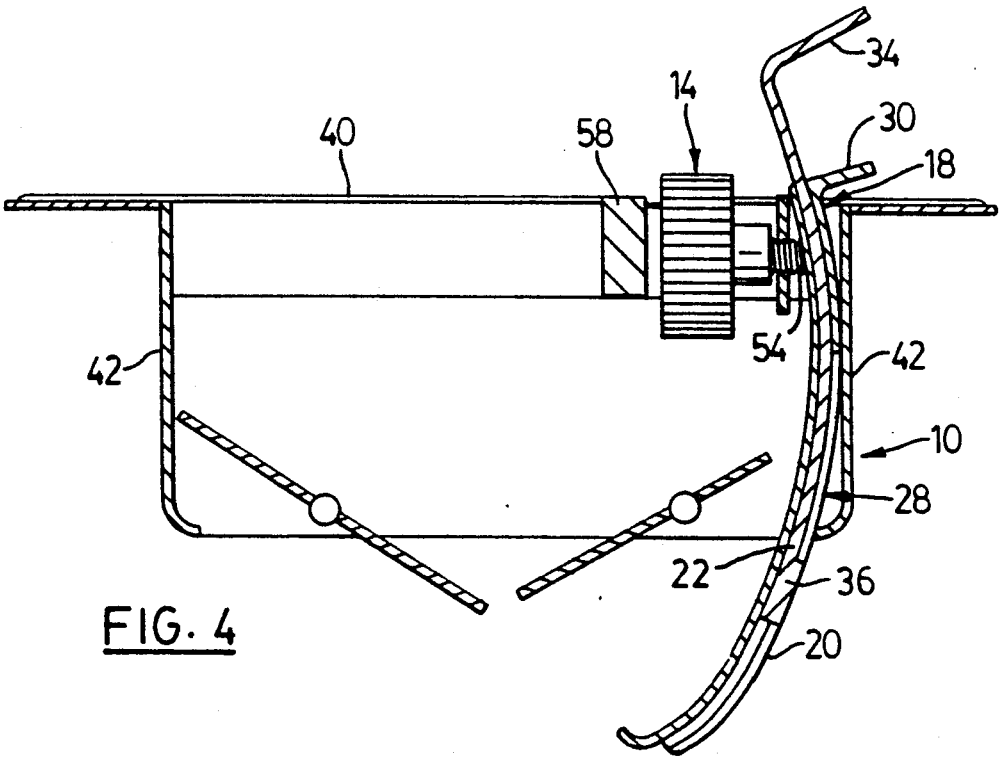
FIG. 4 is a cross section similar to FIG. 3 wherein the deflector is nested.

In the operation of the above described embodiment, deflector 12 may be moved from a position of rest as shown in FIGS. 1 and 4 to an upwardly extended position as shown in FIGS. 2 and 3. In its position of rest, deflector 12 is held in a nested position by upper flanges 30 and 34, flange 30 resting against side edge 18 of frame 10 and flange 34 resting against flange 30 (see FIG. 1). Deflector 12 is extended manually by pulling up on flange 34 to the desired height with outer sheet 20 first sliding out from slot 18 and then inner sheet 22 sliding out from outer sheet 20 until stop 36 abuts the upper end of slot 38. When outer sheet 20 has been extended a predetermined amount it is retained in position by rotating thumbwheel 52 to have shaft 54 bear against it, after which inner sheet 22 may be further extended to any preselected position limited by stop 36 abutting the upper end of slot 38. To return deflector 12 to its nesting position thumbscrew 52 is rotated to disengage shaft 54 from inner wall 26 of outer sheet 20 and sheets 20 and 22 are then pushed into slot 18 by means of flanges 34 and 30.

I claim:

1. An air register comprising:

a register frame defining an air outlet;

a deflector nested in retracted position in the frame and extensible therefrom to a preselected position over the air outlet; and means for releasably retaining the deflector in said preselected position comprising a shaft axially movable transverse to the deflector and means to move the shaft against the deflector.

2. A register as claimed in claim 1 wherein said retaining means includes a thumb wheel keyed on the shaft, the shaft being threaded and mounted for axial rotation in one sense to clamp against the deflector.

3. A register as claimed in claim 2 including a backstop fixed in the frame such that rotation of the thumbwheel in an opposite sense to said one sense brings the thumbwheel into abutment against said backstop whereby the shaft is prevented from being disengaged.

4. A register as claimed in claim 1 in which the deflector is movable through a slot in the frame, the deflector comprising at least one arcuate sheet carrying stop means defining the end limits of movement of the deflector, said stop means comprising a pair of flanges located one on each opposed edge of the deflector.

5. A register as claimed in claim 4 in which the deflector comprises two arcuate sheets slidable one with respect to the other.

6. A register as claimed in claim 5 in which the sheets are telescopic.

7. A register as claimed in claim 5 in which one arcuate sheet carries further stop means engageable in a slot in the other arcuate sheet to define the end limits of movement of one sheet with respect to the other sheet.

* * * * *